US008142224B2

(12) United States Patent
Wu

(10) Patent No.: US 8,142,224 B2
(45) Date of Patent: Mar. 27, 2012

(54) CABLE ASSEMBLY WITH IMPROVED SHIELDING MEMBER

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 19 days.

(21) Appl. No.: 12/853,469

(22) Filed: Aug. 10, 2010

(65) Prior Publication Data

US 2011/0034061 A1 Feb. 10, 2011

(51) Int. Cl.
*H01R 13/648* (2006.01)

(52) U.S. Cl. ..... 439/607.27; 439/353

(58) Field of Classification Search ..... 439/352, 439/353, 357, 358, 607.27, 607.35, 607.36, 439/607.37, 607.45, 626, 660
See application file for complete search history.

(56) References Cited

U.S. PATENT DOCUMENTS

| | | | | |
|---|---|---|---|---|
| 6,997,733 | B2 * | 2/2006 | Peng | 439/353 |
| 7,175,465 | B1 * | 2/2007 | Tsai | 439/352 |
| 7,422,066 | B2 * | 9/2008 | Rodrigues et al. | 166/341 |
| 7,422,465 | B2 * | 9/2008 | Watanabe et al. | 439/353 |
| 7,628,638 | B2 * | 12/2009 | Wu | 439/358 |

FOREIGN PATENT DOCUMENTS

CN 200420022197 9/2005

* cited by examiner

*Primary Examiner* — Thanh Tam Le
(74) *Attorney, Agent, or Firm* — Wei Te Chung; Andrew C. Cheng

(57) ABSTRACT

An cable assembly includes an insulative housing; a plurality of terminals received in the insulative housing; a cable having a plurality of wires connected to the terminals; and a metallic shell enclosing the insulative housing and the terminals, the metallic shell includes a first shell, a second shell and a third shell, the first shell enclosing the second shell, and the third shell arranged between the first shell and the second shell.

20 Claims, 9 Drawing Sheets

CABLE ASSEMBLY WITH IMPROVED SHIELDING MEMBER

FIELD OF THE INVENTION

The present invention generally relates to a cable assembly, and more particularly to a cable assembly with an improved shielding member.

DESCRIPTION OF PRIOR ART

Nowadays, an electrical device has become lower profile and multi-functional, and a cable assembly for the electrical device is also capable of high-speed transmitting, and reliably connection and easily detachable with its counterpart.

CN patent No. 200420022197 issued to Peng on Sep. 7, 2005 discloses a cable assembly. The cable assembly has an insulative housing with two side arms extending rearwardly therefrom, two locking members respectively fixed to the two side arms, and an insulator accommodated in a space formed between the two side arms, and two strips fastened to the two side arms to retain the two locking members. A front and a back metal covers are provided to shield the insulative housing and terminating area between contacts of the plug connector and a cable. The front metal cover and the back metal cover are bonded by the 360 degrees circumferential weld. An external cover is mounted to the front cover and the back cover, the external cover has a deformable button capable of actuating the locking members to disconnect the plug connector and the socket connector. The aforementioned cable assembly requires welding process to seal an interface between the front metal cover and the back metal cover so as to achieve better anti-EMI effect, however, if there is a big gap between the interface, much welding material and more effort is needed.

Hence, an improved cable assembly is highly desired to overcome the aforementioned problems.

SUMMARY OF THE INVENTION

Accordingly, an object of the present invention is to provide a lower profile and easily manufactured cable assembly.

In order to achieve the object set forth, a cable assembly in accordance with the present invention comprises an insulative housing; a plurality of terminals received in the insulative housing; a cable having a plurality of wires connected to the terminals; and a metallic shell enclosing the insulative housing and the terminals, the metallic shell includes a first shell, a second shell and a third shell, the first shell enclosing the second shell, and the third shell arranged between the first shell and the second shell.

Other objects, advantages and novel features of the invention will become more apparent from the following detailed description when taken in conjunction with the accompanying drawings.

DETAILED DESCRIPTION OF PREFERRED EMBODIMENTS

Figure 1:
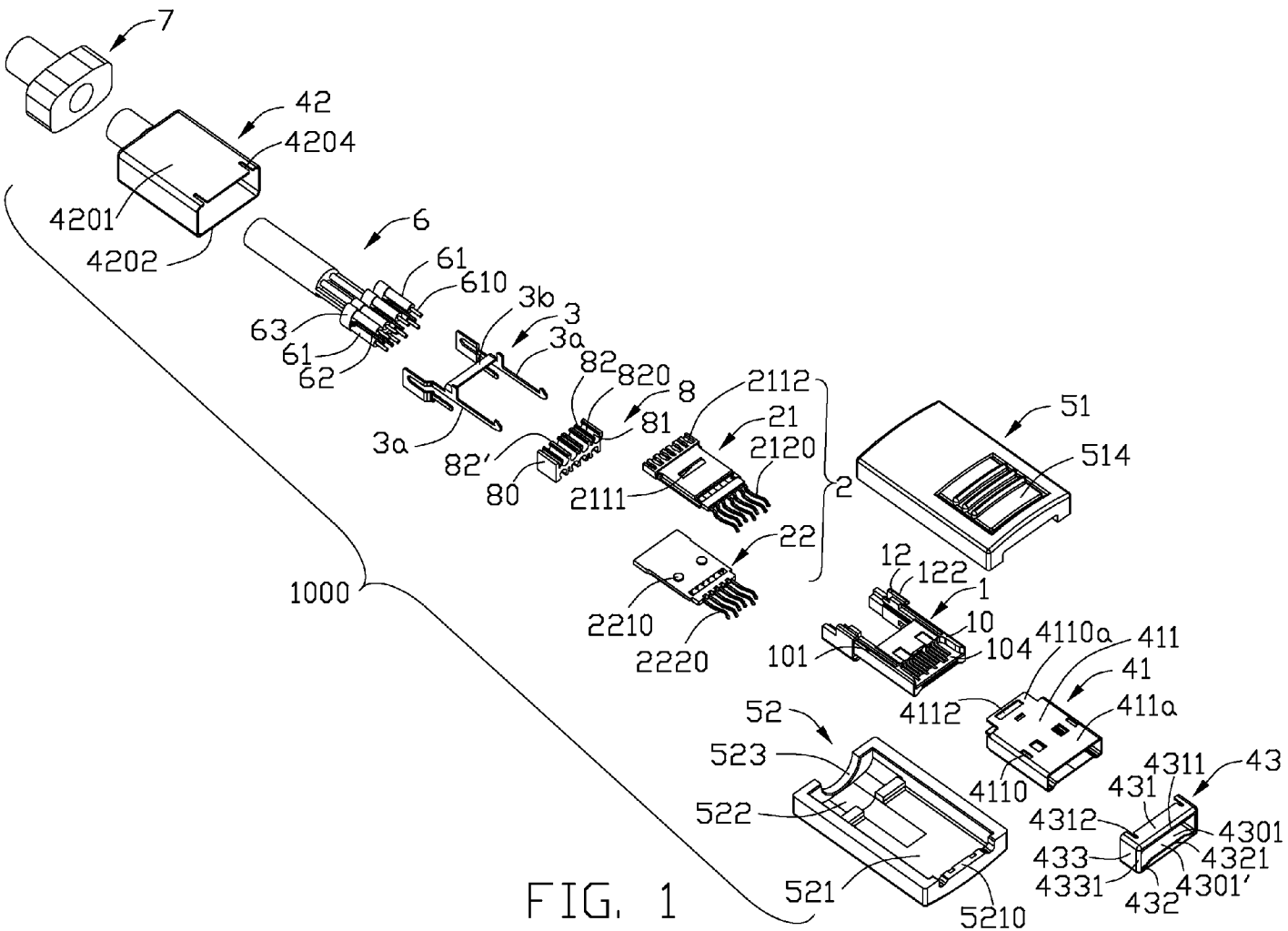
FIG. 1 is an exploded, perspective view of a cable assembly in accordance with the present invention.

Reference will now be made in detail to the preferred embodiment of the present invention.

Referring to FIGS. 1-9, a cable assembly 1000 in accordance with the present invention comprises an insulative housing 1, a terminal module 2, a latching mechanism 3, a metallic shell 4, an external cover 5, a cable 6, a strain relief 7 and an insulative spacer 8.

The insulative housing 1 includes a main portion 10 and two mounting arms 12 extending rearwardly from lateral sides of the main portion 10. A receiving space 102 is recessed forwardly from a middle segment of a rear edge of the main portion 10. A cavity 104 is recessed downwardly from a front segment of a top side of the main portion 10 and further communicates with the receiving space 102. A depression 104' is defined in a lower side of the main portion 10, and the depression 104' is of isosceles trapezoid shape, which has a horizontal side 1041' and two oblique sides 1041', 1042'. A slot 101 is defined in the mounting arm 12 and partial of main portion 10 in front of the mounting arm 12. A positioning hole 126 is defined in a rear portion 124 of the mounting arm 12, and a standoff 122 is formed on middle portion of the mounting arm 12 and projected upwardly.

The terminal module 2 includes a first terminal module 21 and a second terminal module 22. The first terminal module 21 has an insulator 211 and a number of terminals 212 combined together by insert-molding process. The terminals 212 are divided into signal terminals and grounding terminals configured to be longer than the signal terminals. The terminals 212 have contacting portions 2120 disposed in front of an edge of the insulator 211 and tail portions 2122 which are accommodated in terminal slots 2112 defined in a back segment of the insulator 211. Two mounting holes 2110 are defined in a bottom side of the insulator 211 and a protruding portion 2111 are formed on a top side of the insulator 211.

The second terminal module 22 has an insulator 221 and a number of terminals 222 combined together by insert-molding process. The terminals 222 are divided into signal terminals and grounding terminals configured to be longer than the signal terminals. The terminals 222 have contacting portions 2220 disposed in front of an edge of the insulator 221 and tail portions 2222 which are accommodated in terminal slots 2212 defined in a back segment of the insulator 221. Two mounting posts 2210 are formed on a top side of the insulator 221. There are two protruding portions 2214 formed on a bottom side of the insulator 221.

The first terminal module 21 and the second terminal module 22 are assembled together, with the contacting portions 2120, 2220 merged into one row, while the tail portions 2122, 2222 separated into two distinct rows along an up-to-down direction. The mounting posts 2210 are inserted into the mounting holes 2110 so as to keep the first terminal module 21 and the second terminal module 22 together. The first terminal module 21 and the second terminal module 22 are assembled to the insulative housing 1, with front segments of the insulators 211, 221 inserted into the receiving space 102.

The latching mechanism 3 includes two latching members **3*a* separated from each other along a transversal direction and a transversal arm 3***b* connected to the two latching members 3*a* together. Each latching member 3*a* includes a connecting arm 30, a latching arm 32 and a retention arm 33. The latching arm 32 and the retention arm 33 are spaced apart from each other and extend forwardly from the connecting arm 30. The latching arm 32 and the retention arm 33 are located in a vertical plane. The connecting arm 30 has a U-shaped body portion 31 and a first bridge portion 311 and a second bridge portion 312 formed with front ends of the body portion 31. The first bridge portion 311 and the second bridge portion 312 are inwardly deflected and extend forwardly to engage with the latching arm 32 and the retention arm 33, respectively. Therefore the U-shaped body portion 31 is disposed in other vertical plane and parallel to the latching arm 32 and the retention arm 33. A tab 324 is formed on a top side of the latching arm 32 and proximate the first bridge portion 311. The retention arm 33 is inserted into the positioning hole 126 of the mounting arm 12, and the latching arm 32 is received in the slot 101 of the insulative housing 1. The connecting arm 30 is located behind the mounting arm 12 and adjacent to an outer surface of the mounting arm 12, therefore, more space is left inside the connecting arm 30.

The metallic shell 4 has a first shell 41, a second shell 42 and a third shell 43.

The first shell 41 includes a frame 411 to accommodate the main portion 10 therein. Two through holes 4110 are defined in a front segment of a top side 411*a* of the frame 411 to allow hooks 322 of the latching arms 32 passing through. A first engaging portion 4110*a* projects backward from the top side 411*a*. There is a positioning hole 4112 defined in the first engaging portion 4110*a* to latch with the protruding portion 2111 of the first terminal module 21. The frame 411 further has an inwardly recessed bottom side 411*b* suitably matching with the depression 104' of the insulative housing 1. A second engaging portion 4110*b* projects backward from the bottom side 411*b*. There are two positioning holes 4114 defined in the second engaging portion 4110*b* to latch with the protruding portions 2214 of the second terminal module 22.

The second shell 42 includes a rectangular shaped main portion 420 which has an upper side 4201, a lower side 4202, a back side 4203 and two lateral sides (not numbered) joined together. The second shell 42 further includes a boot 421 extending backwardly from the back side 4203. Two notches 4204 are defined in lateral sides of a front segment of the up side 4201.

The third shell 43 includes a rectangular shaped body portion 430 which has a top side 431, a bottom side 432 and two lateral sides 433 connected together. The third shell 43 has a front opening 4301 and a rear outlet 4302. There are flanges 4311, 4321 and 4311 formed on front edges of the body portion 430 and further extend into the front opening 4301 to form a shrinkable opening 4301'. The shrinkable opening 4301' can fully match with an circumference of the frame 411. Two slits 4312 are defined in lateral sides of back segment of the top side 431.

The external cover 5 includes an upper cover 51 and a bottom cover 52. The upper cover 51 has a first hollow 511 and a second hollow 512 disposed behind the first hollow 511. A rectangular shaped opening 5110 is located in the front portion of the upper cover 51, and the opening 5110 further communicates with the first hollow 511. A semicircular shaped outlet 513 is defined in the rear portion of the upper cover 51 and communicated with the second hollow 512. A deformable button 514 is integrally formed with the upper cover 51 and floatable along up-to-down direction to enter the first hollow 511 so as to actuate the tab 324 of the latching arm 32.

The bottom cover 52 is similar to the upper cover 51, and also has a first hollow 521 and a second hollow 522 disposed behind the first hollow 521. An opening 5210 is located in the front portion of the bottom cover 52, and the opening 5210 further communicates with the first hollow 521. A semicircular shaped outlet 523 is defined in the rear portion of the bottom cover 52 and communicated with the second hollow 522.

The cable 6 includes a number of wire groups enclosed in a jacket 60. Each wire group includes a pair of signal wires 61 and a grounding wire 62 disposed aside the pair of wires 61, and a shielding member 63 shrouding the pair of wires 61. The shielding member 63 is aluminum foil or other similar structure. The strain relief member 7 is molded over a front segment of the cable 6 and accommodated in the second hollows 512, 522.

The insulative spacer 8 includes a main portion 80 which has a number of positioning cavities 81 respectively defined in a top and a bottom segments thereof. The positioning cavities 81 are arranged between first protrusions 82 and second protrusions 82'. The first protrusions 82 and the second protrusions 82' are disposed in alternated manner along a transversal direction. In addition, the first protrusions 82 are broader than the second protrusions 82'. Each of the first protrusions 82 defines a groove 820 therein. The groove 820 is narrower than the positioning cavity 81.

The insulative spacer 8 is mounted to a back side of the first terminal module 21 and the second terminal module 22. The pair of signal wires 61 of the each wire group are held in the two positioning cavities 81 at the top and the bottom sides of the main portion 80, and conductors 610 inside the signal wires 61 extend into the terminal slots 2112, 2222 and are placed on the tail portions 2122, 2222 so as to achieve electrical connection therebetween. The grounding wire 62 is positioned in a corresponding groove 820 and further extends into terminal slot 2112/2222. The conductors 610 are soldered to tail portions of the signal terminals, and the grounding wires 62 are soldered to tail portions of the grounding terminals. The spacers 8 are used for organizing the wires of the cable 6 so as to facilitate soldering process.

The first shell 41 encloses the main portion 10 of the insulative housing 1, the third shell 43 encloses back segment of the first shell 41, with the flanges 4311, 4321 abutting against stoppers 4117, 4118 which are formed on the top side 411*a* and the bottom side 411*b*. The second shell 42 encloses the third shell 43 and the cable 6 extends outward through the boot 421. The tab 324 of the latching arm 32 upwardly extends outward via the slit 4312 and the notch 4204. As the third shell 43 is put into a gap/interface between the first shell 41 and the second shell 42, therefore better shielding benefit is acquired. In addition, the first shell 41, a second shell 42 and a third shell 43 are simple and easily manufactured.

Figure 2:
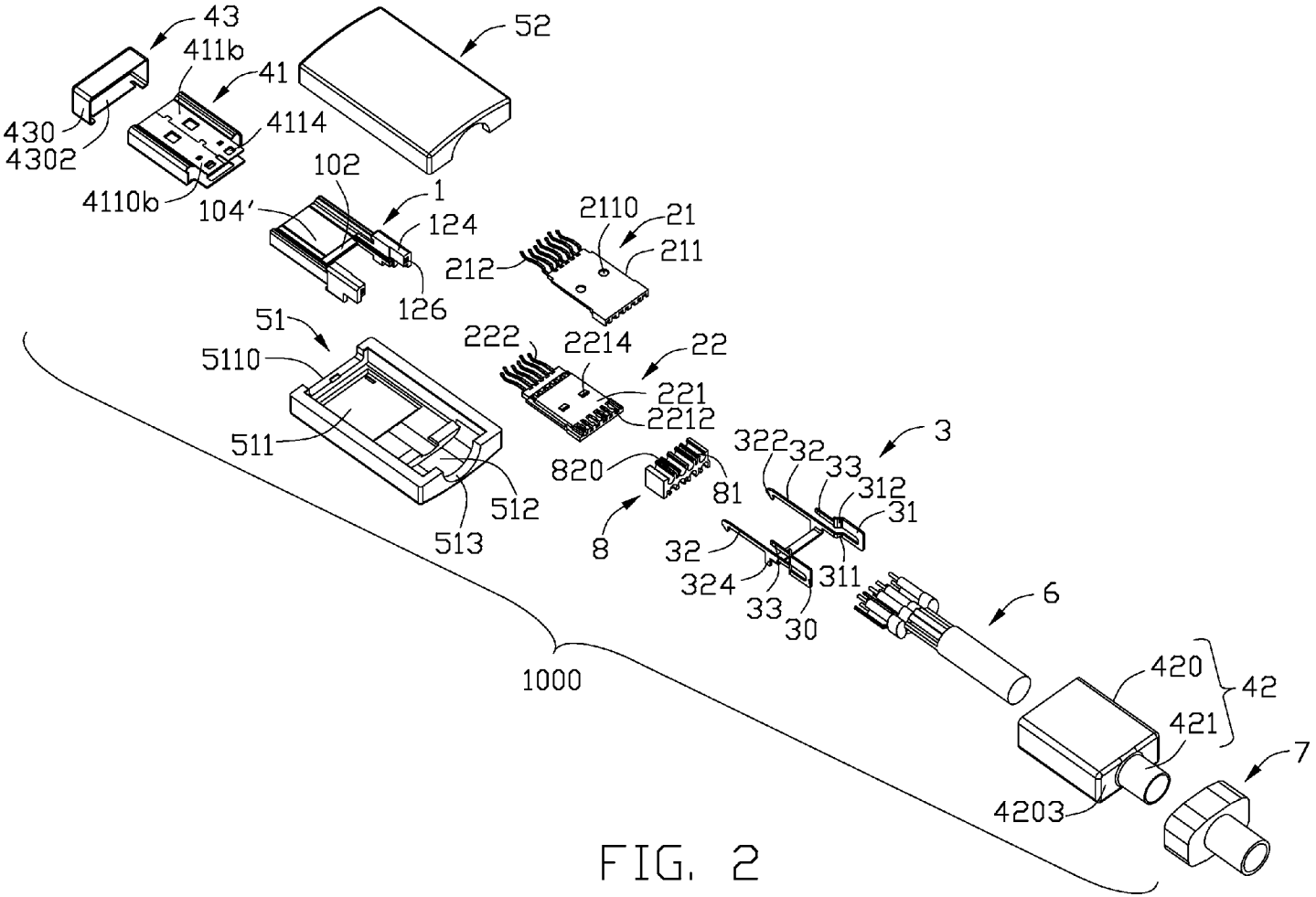
FIG. 2 is similar to FIG. 1, but viewed from another aspect.
Figure 3:
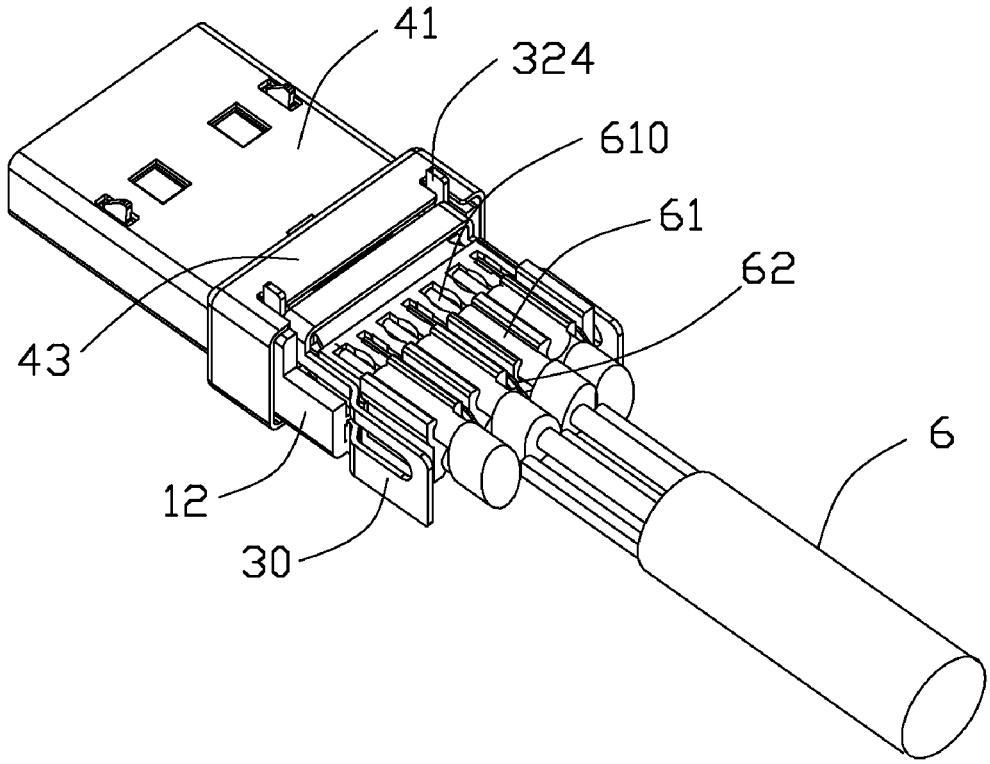
FIG. 3 is a partially assembled view of the cable assembly.
Figure 4:
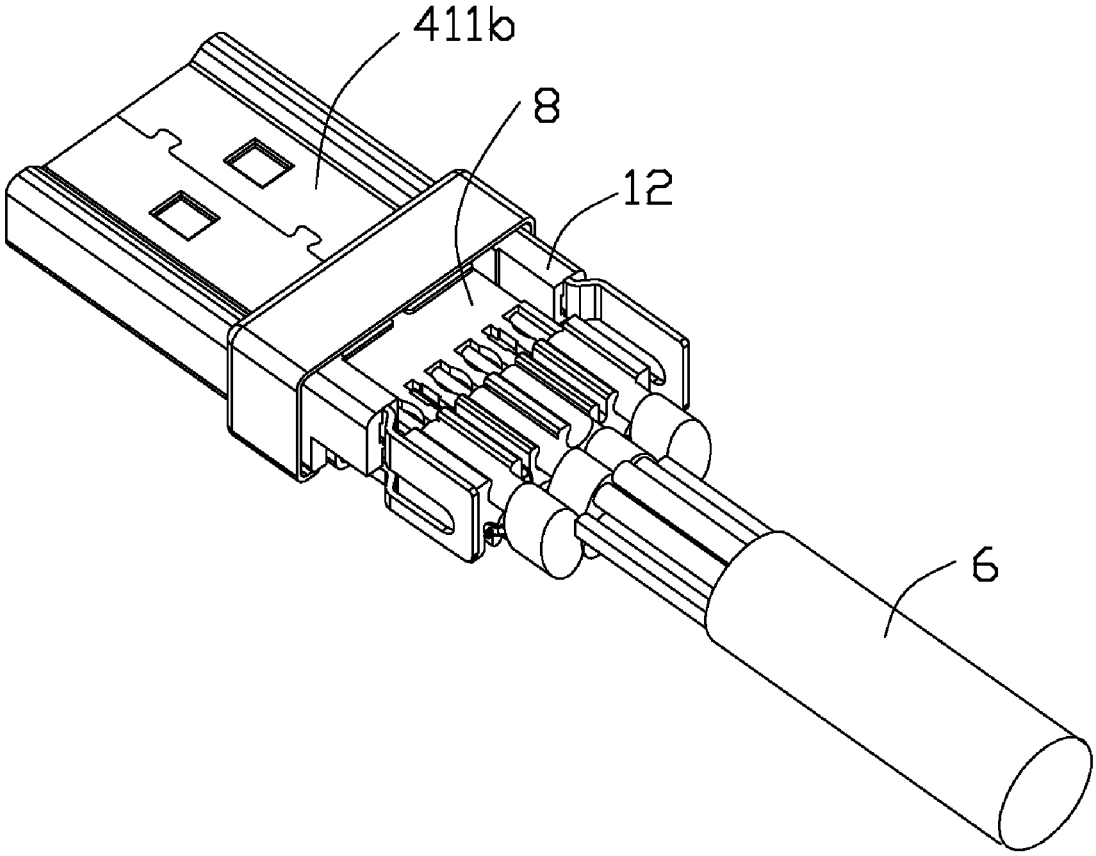
FIG. 4 is similar to FIG. 1, but viewed from another aspect.
Figure 5:
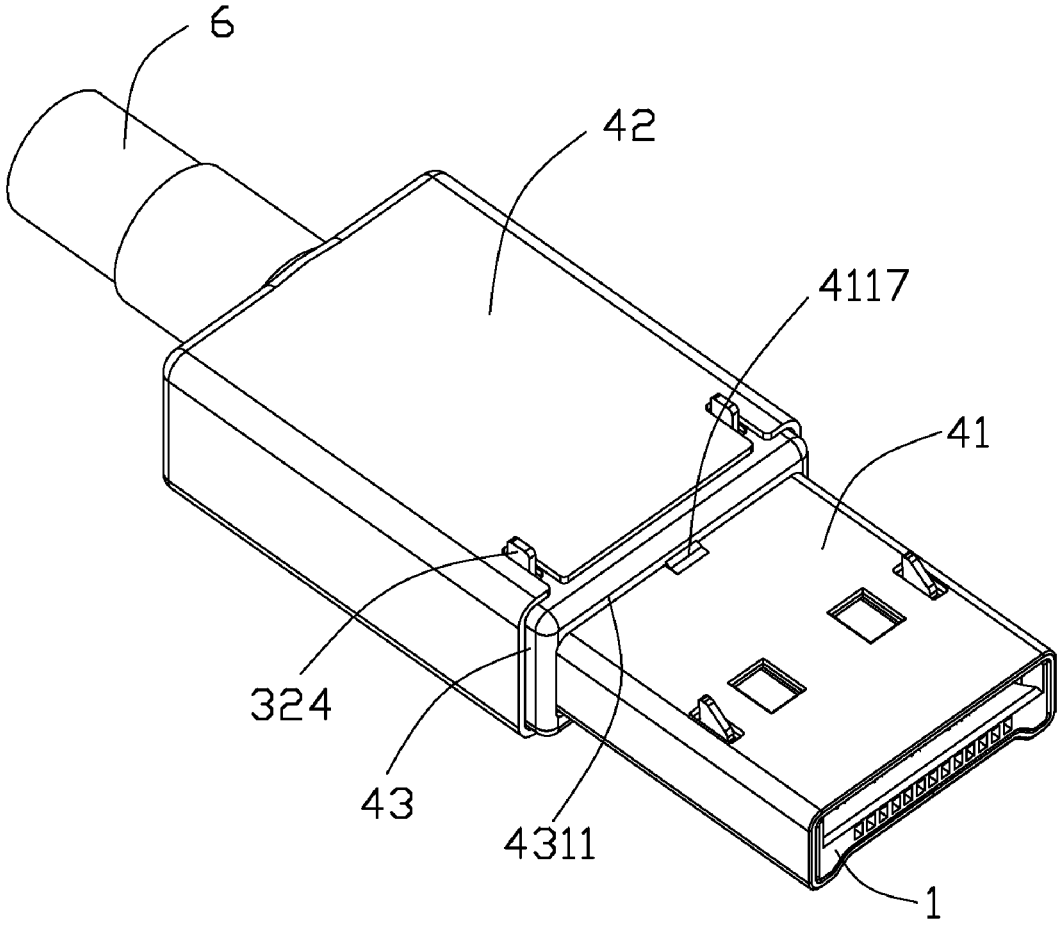
FIG. 5 is other partially assembled view of the cable assembly.
Figure 6:
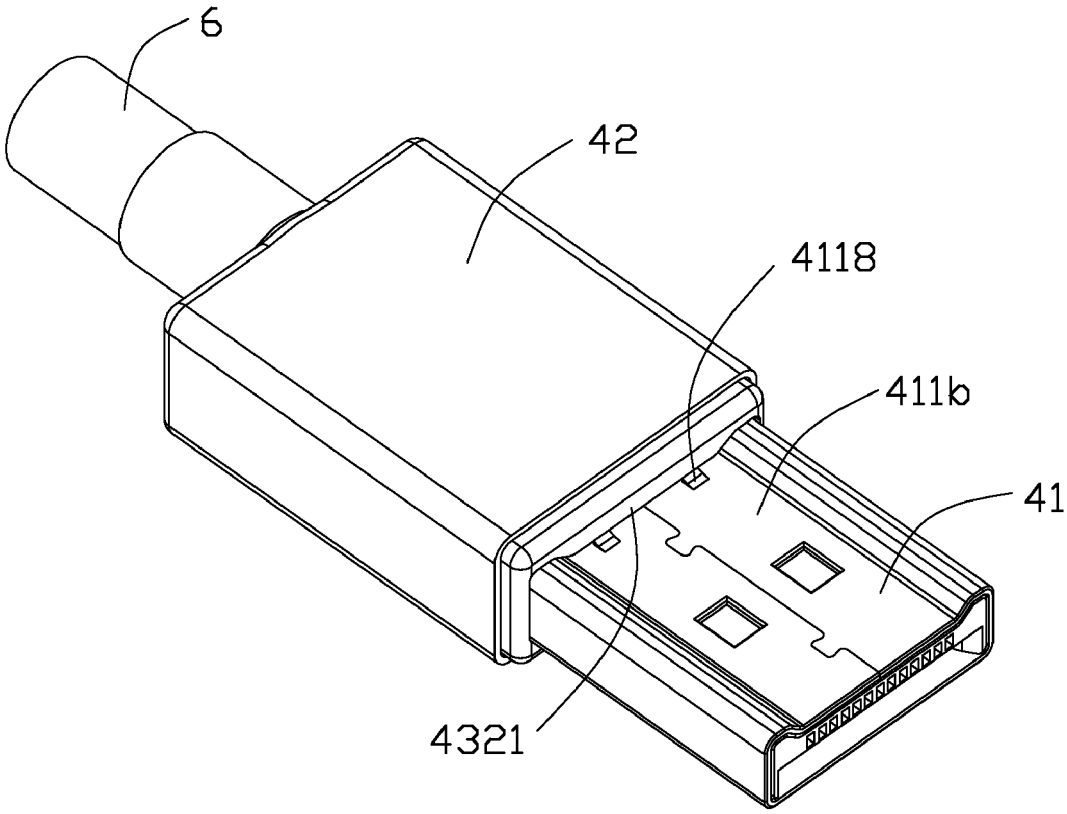
FIG. 6 is similar to FIG. 5, but viewed from another aspect.
Figure 7:
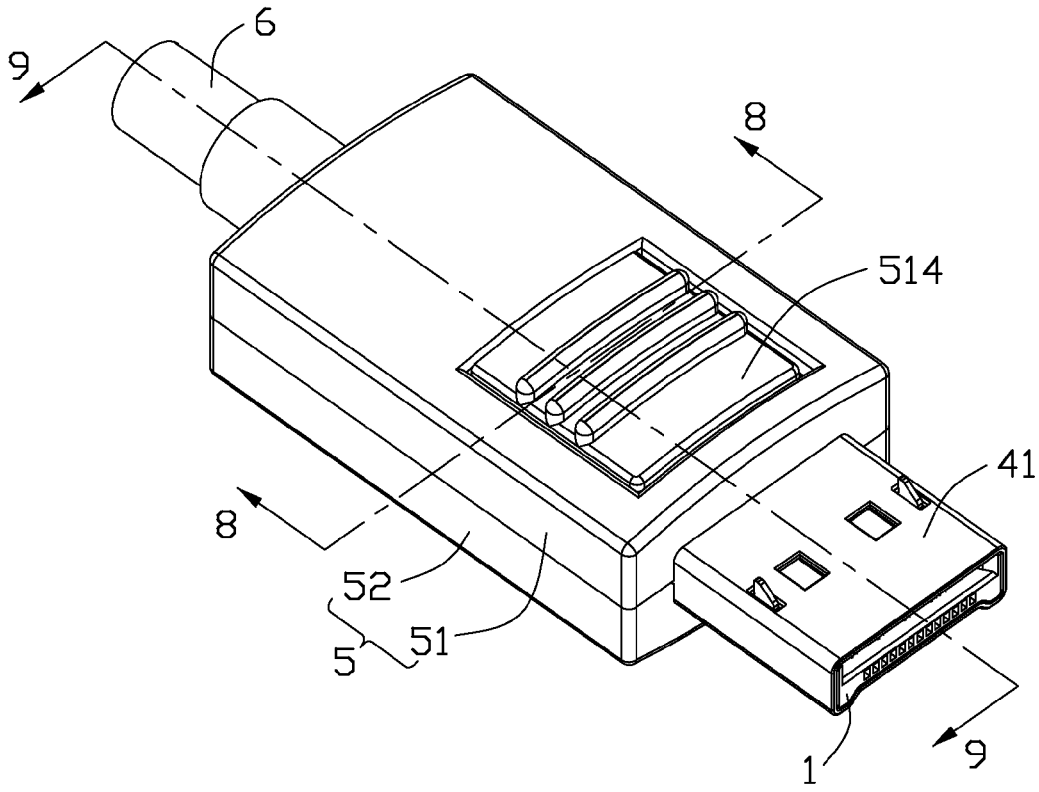
FIG. 7 is an assembled, perspective view of the cable assembly.
Figure 8:
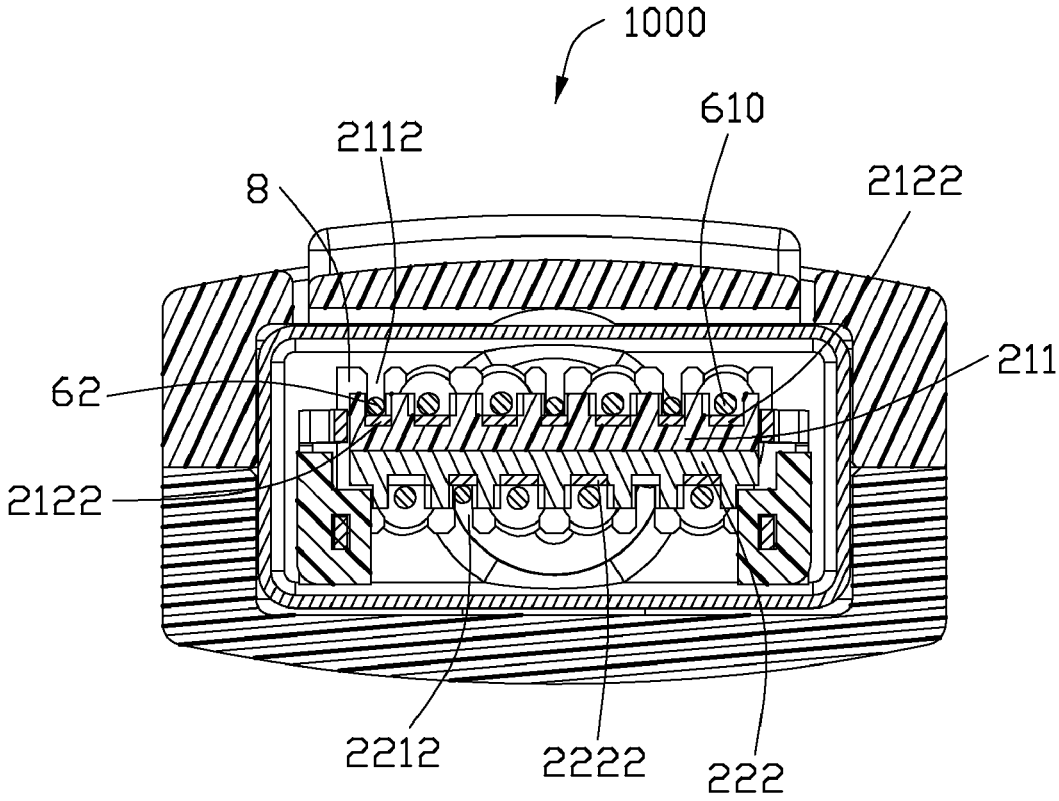
FIG. 8 is a cross-section view taken along line 8-8 of FIG. 7.
Figure 9:
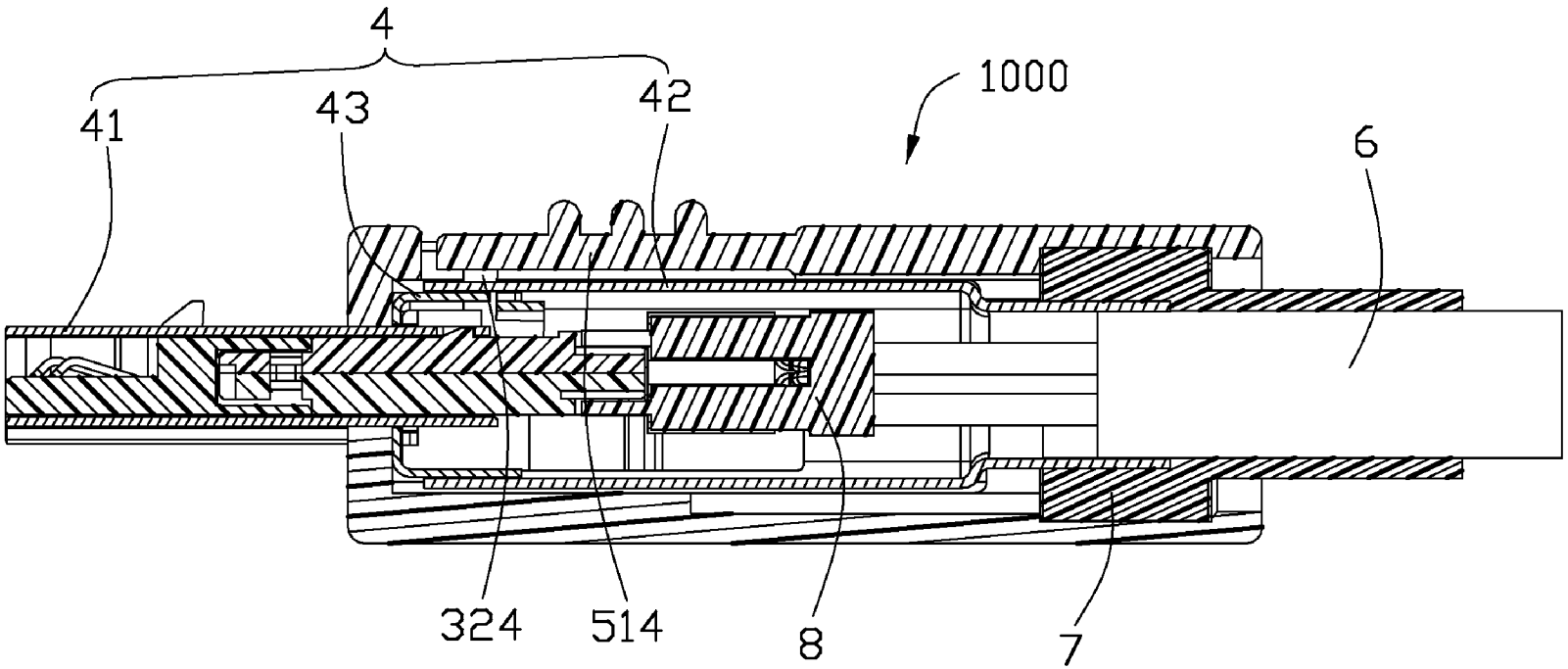
FIG. 9 is a cross-section view taken along line 9-9 of FIG. 7.

The cable assembly 100 is in accordance with DiiVA (Digital Interactive Interface for Video & Audio) standard. Referring to FIG. 1-2, within the cavity 104, along a left-to-right direction, there are thirteen terminals 212, 222 which are arranged in such manner: G-S-S-G-S-S-G-S-S-G-G-S-S. G represents grounding terminal, and S represent signal terminal There are three differential pairs consisted of six signal terminals located between grounding terminals. The differential pairs for high-speed transmitting used for conveying video signals. And a pair of signal terminals disposed in the right side cavity 104 used for audio signals.

When detach the cable assembly 100 from a complementary connector, just press the deformable button 514 to actuate the tab 324 of the latching arm 32, and the latching arm 32 retreat into the slots 101. When the pressing force is withdrawn, the deformable button 514 restored to their original positions, and the latching arms 32 also upwardly movement by rebounded force of the resilient tabs 304.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

an insulative housing;

a plurality of terminals received in the insulative housing;

a cable having a plurality of wires connected to the terminals; and a metallic shell enclosing the insulative housing and the terminals, the metallic shell includes a first shell, a second shell and a third shell, the first shell enclosing the second shell, and the third shell arranged between the first shell and the second shell;

wherein the third shell encloses a back segment of the first shell and the second shell encloses the third shell;

wherein the third shell includes a body portion which has a top side, a bottom side and two lateral sides connected together, and the body portion has a front opening and a rear outlet; and wherein a plurality of flanges formed on front edges of the body portion and extending into the front opening to form a shrinkable opening.

2. The cable assembly as recited in claim 1, wherein the third shell encloses a back segment of the first shell, and the second shell encloses the third shell.

3. The cable assembly as recited in claim 2, wherein the third shell includes a body portion which has a top side, a bottom side and two lateral sides connected together, and the body portion has a front opening and a rear outlet.

4. The cable assembly as recited in claim 3, wherein there are a plurality of flanges formed on front edges of the body portion and extending into the front opening to form a shrinkable opening.

5. The cable assembly as recited in claim 1, wherein the first shell has a frame to accommodate the insulative housing.

6. The cable assembly as recited in claim 5, wherein the shrinkable opening fully matches with a circumference of the frame.

7. The cable assembly as recited in claim 6, wherein the frame has a top side and an inwardly recessed bottom side matching with a depression defined in the insulative housing.

8. The cable assembly as recited in claim 7, wherein there are stoppers formed on the top side and the bottom side of the frame, and the flanges of the third shell abut against the stoppers.

9. The cable assembly as recited in claim 1, wherein the second shell includes a main portion which has an upper side, a lower side, a back side and two lateral sides joined together, and a boot extends backwardly from the back side.

10. The cable assembly as recited in claim 9, wherein a boot extends backwardly form the back side, and the cable extends outwardly through the boot.

11. The cable assembly as recited in claim 1, further comprising an insulative spacer located behind the insulative housing.

12. The cable assembly as recited in claim 11, wherein there are a plurality of positioning cavities and grooves defined in a top and a bottom segments of the insulative spacer, and the positioning cavities are broader than the groove.

13. The cable assembly as recited in claim 12, wherein the cable includes a plurality of signal wires and grounding wires, and the signal wires are accommodated in the positioning cavities and soldered to corresponding signal terminals, and the grounding wires are accommodated in the grooves and soldered to corresponding grounding terminals.

14. The cable assembly as recited in claim 1, further comprising a latching member.

15. The cable assembly as recited in claim 14, wherein the latching member includes a connecting arm, a latching arm and a retention arm, the retention arm is fixed to the insulative housing.

16. The cable assembly as recited in claim 15, wherein the latching arm has a hook formed at a front end thereof and protrudes outward through a corresponding hole defined in a front segment of a top side of the first shell.

17. The cable assembly as recited in claim 15, wherein there is a tab formed on the latching arm and upwardly extending outward via a slit of the third shell and a notch of the second shell.

18. The cable assembly as recited in claim 17, wherein there is an external cover enclosing the second shell and the third shell, and the external cover defines a deformable button disposed proximate the tab of the latching arm.

19. An electrical cable connector assembly comprising:

a one piece insulative housing defining a front small section and a rear large section;

a first metallic shell enclosing the front small section, a second metallic shell discrete from said first metallic shell and enclosing the rear large section;

a third metallic shell discrete from both said first metallic shell and said second metallic shell and essentially radially located inside of the second metallic shell; and a pair of latches on two sides, wherein each of said latches includes a front hook section extending through the first metallic shell, and a rear pressing section extending through both the second metallic shell and the third metallic shell;

wherein said second metallic shell includes portions extending along a boundary between said small section and said large section while both said first metallic shell and said second metallic not.

20. The electrical cable connector assembly as claimed in claim 19, further including a pair of latches on two sides, wherein each of said latches includes a front hook section extending through the first metallic shell, and a rear pressing section extending through both the second metallic shell and the third metallic shell.

* * * * *